United States Patent [19]

Wadensten et al.

[11] 4,346,822

[45] Aug. 31, 1982

[54] AIR BLASTER OR AIR ACCUMULATOR AND QUICK DUMP APPARATUS

[75] Inventors: Theodore S. Wadensten, Wyoming; Alfred Carocci, Johnston, both of R.I.

[73] Assignee: Vibco, Inc., Wyoming, R.I.

[21] Appl. No.: 103,187

[22] Filed: Dec. 13, 1979

Related U.S. Application Data

[62] Division of Ser. No. 945,457, Sep. 25, 1978, Pat. No. 4,197,966.

[51] Int. Cl.[3] ..... B65D 88/72

[52] U.S. Cl. ..... 222/195; 251/30; 406/136

[58] Field of Search ..... 222/195; 406/136, 137; 251/30

[56] References Cited

U.S. PATENT DOCUMENTS

| | | | |
|---|---|---|---|
| 2,815,921 | 12/1957 | Bigelow | 251/30 X |
| 3,788,527 | 1/1974 | Matson | 222/389 X |
| 4,051,982 | 10/1977 | Stetson | 222/195 |

FOREIGN PATENT DOCUMENTS

| | | | |
|---|---|---|---|
| 951692 | 7/1974 | Canada | 222/195 |

*Primary Examiner*—Robert J. Spar
*Assistant Examiner*—Frederick R. Handren
*Attorney, Agent, or Firm*—Ralph R. Roberts

[57] ABSTRACT

A container for receiving a charge of pressurized air and storing the air in this container until released through a blast nozzle and having a quick dump valve apparatus within this container. The valve includes a removable pipe which contains a large slidable piston which opens and closes the flow of accumulated air to the discharge. This piston is moved in response to a solenoid actuated small piston which is moved in a small tube. This small tube extends through the large piston which slides therealong.

16 Claims, 5 Drawing Figures

AIR BLASTER OR AIR ACCUMULATOR AND QUICK DUMP APPARATUS

CROSS REFERENCE TO RELATED APPLICATION

This is a divisional application based on U.S. application Ser. No. 945,457 filed Sept. 25, 1978 in the names of Theodore S. Wadensten and Alfred Carocci and having the title, "Air Blaster or Air Accumulator and Quick Dump Apparatus". This divisional application is based on the Examiner's restrictive action mailed July 19, 1979, application Ser. No. 945,457 issued as U.S. Pat. No. 4,197,966 on Apr. 15, 1980.

BACKGROUND OF THE INVENTION

1. Field of the Invention

With reference to the classification of art as established in and by the U.S. Patent and Trademark Office the present invention is believed to be found in the general class entitled, "Dispensing" (Class 222) and in the subclass entitled, "signal or exhibitor" (subclass 3) and also in the subclass entitled, "with fluent material dispenser" (subclass 96).

2. Description of the Prior Art

It is not new to use air blasting to jar or otherwise assist in the movement or flow of material from bins or the like. Many U.S. patents and commercial arrangements have produced apparatus in which pressurized air is accumulated in a chamber or tank and then at a desired time is released through a nozzle or pipe in a few milli-seconds into the interior of the bin. Presently, air blasting apparatus includes a receiver tank, a large outlet, a quick dump valve, and a source of pressurized air. This apparatus often is actuated by cutting off the supply of air to the valve which then causes the piston to cycle and release the stored pressurized air in the chamber for a short blast into the bin.

In known apparatus the actuating mechanism usually is a valve exterior of the tank or container. Often a small amount of pressurized air is discharged into the atmosphere and for blast efficiency is wasted. In the present invention an inexpensive solenoid replaces the more expensive two and three-way spool valves. The quick dump apparatus is within the tank or container and all pressurized air received into the tank is sent from the large discharge nozzle. The apparatus is of inexpensive construction and may be mass produced and easily repaired.

SUMMARY OF THE INVENTION

This invention may be summarized, at least in part, with reference to its objects.

It is an object of this invention to provide, and it does provide, an air blaster unit in which the quick dump apparatus is completely within the receiving tank.

It is a further object of this invention to provide, and it does provide, apparatus in which a quick dump piston is moved by pressurized air acting on an outer ring portion on the forward face of the piston.

It is a further object of this invention to provide, and it does provide, a one-way valve which is actuated by a small piston in a centrally disposed small tube. This tube is moved to two limits by a solenoid which is remotely actuated.

It is a further object of this invention to provide, and it does provide, a method of providing and actuating a quick dump valve having a piston movable in response to a small piston and one-way valve.

In brief, in one embodiment the quick dump valve apparatus of this invention provides a tank of determined size and having one large opening into which is mounted the blast nozzle and apparatus. A pipe-type of insert is mounted in this large opening and in this inserted unit is mounted a front retainer ring. A pipe piston is movable in a regular bore of this pipe and at its forward position this piston closes large dump holes through the forward wall of the pipe. This piston at its rearward limit engages a spacer disc having a one-way valve means formed therein. A small tube extends through this pipe piston which is slidable therealong. This small tube has a small tubular seal midlength thereof which forms a stop for a small piston carried in this tube and moved by a solenoid. Pressurized air is fed to this tube from an outside source. At the forward limit of this small piston pressurized air is fed through the tube to the rear of the small piston. Pressurized air passes through holes in the tube and urges the pipe piston forwardly to a close-off condition. This pressurized air flows through the one-way valve and thence to the tank. At its other limit of movement, the small piston shuts off flow of the pressurized air in the tube, exhausts the air to the rear of the pipe piston and discharges this air to the blast nozzle.

In addition to the above summary the following disclosure is detailed to insure aid in understanding of the invention. This disclosure, however, is not intended to cover each new inventive concept therein no matter how it may later be disguised by variations in form or additions of further improvements. For this reason there has been chosen a specific embodiment of the air blaster and the quick dump apparatus as adopted for use in a pipe mounted in a large discharge and showing a preferred means for the construction of this dump valve apparatus. This specific embodiment has been chosen for the purpose of illustration and description as shown in the accompanying drawings wherein:

BRIEF DESCRIPTION OF THE DRAWINGS

In the following description and in the claims various details are identified by specific names for convenience. The names, however, are intended to be generic in their application. Corresponding reference characters refer to like members throughout the several figures of the drawings.

The drawings accompanying, and forming part of, this specification disclose certain details of construction for the purpose of explanation but structural details may be modified in various respects without departure from the concept and principles of the invention and that the invention may be incorporated in other structural forms than shown.

DESCRIPTION OF THE EMBODIMENT AS SEEN IN FIG. 1

Figure 1:
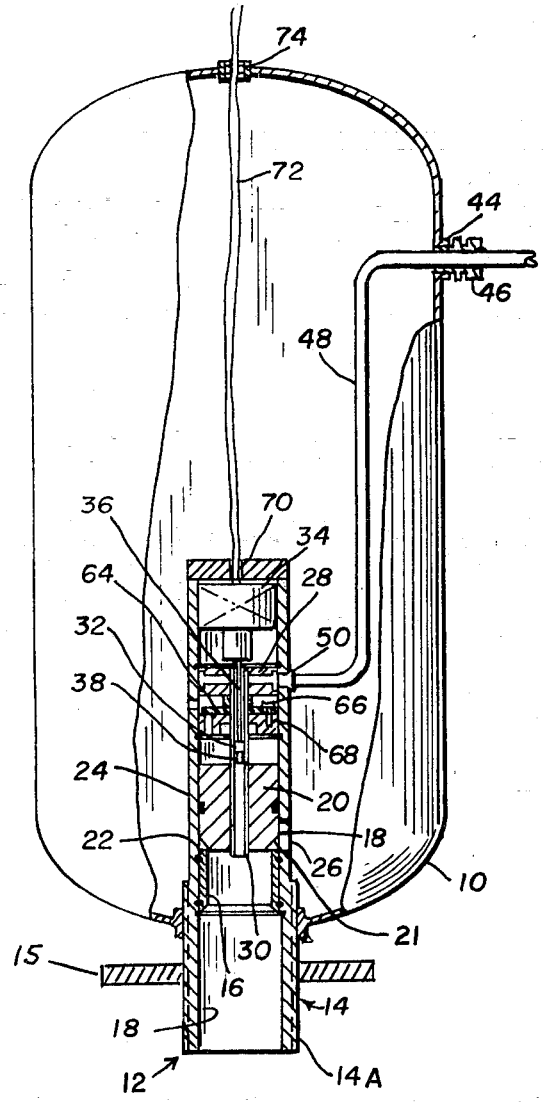
FIG. 1 represents a side view, partly in section, of the air blaster unit as an assembly and showing in particular the construction of a quick release air blast actuated by a small piston that is cycled back and forth by a solenoid to produce a quick dump air blast.
Figure 2:
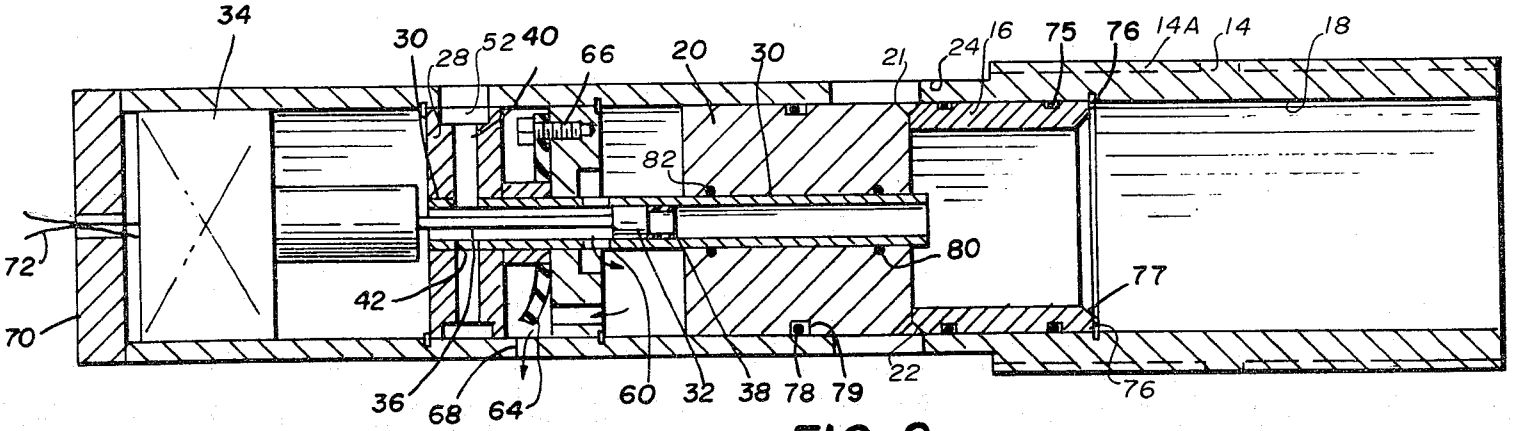
FIG. 2 represents a side view, partly in section and in an enlarged scale of the apparatus for controlling the air blast from a tank, this apparatus carried within a removable pipe, and in this view a small piston is moved forwardly by a solenoid so that pressurized air from an external source is fed to and through a small pipe and through passageways which are opened by moving flapper valve means from in way of passageways and thence into the interior of the tank, the pressurized air also moving a slidable piston to close quick dump holes formed in the delivery end of the pipe.
Figure 3:
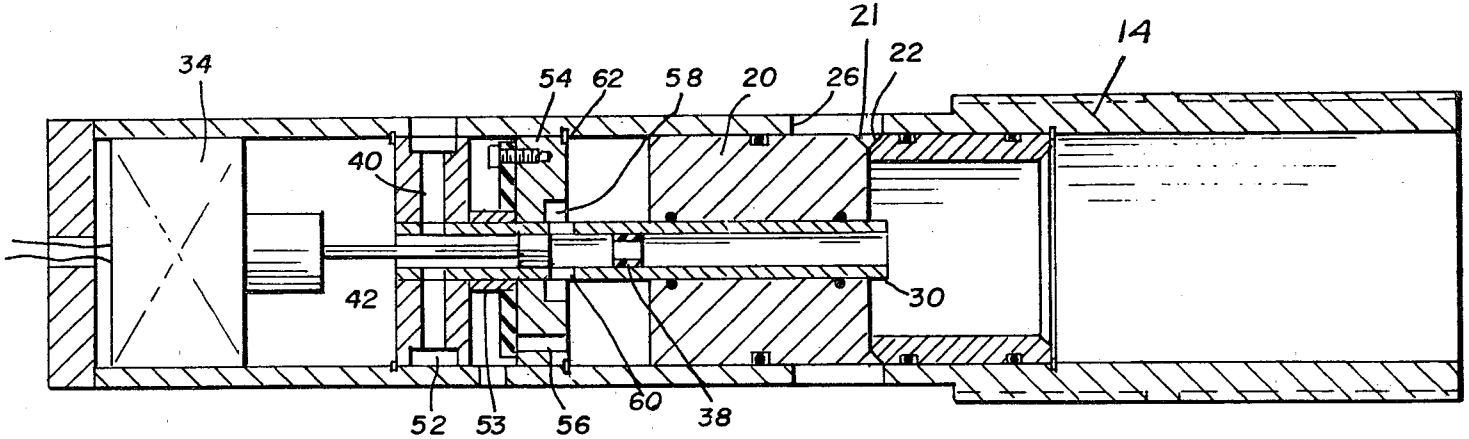
FIG. 3 represents the side view of the apparatus of FIG. 2 with the small piston now moved rearwardly by the solenoid and just prior to the quick dump movement of the sliding piston.
Figure 4:
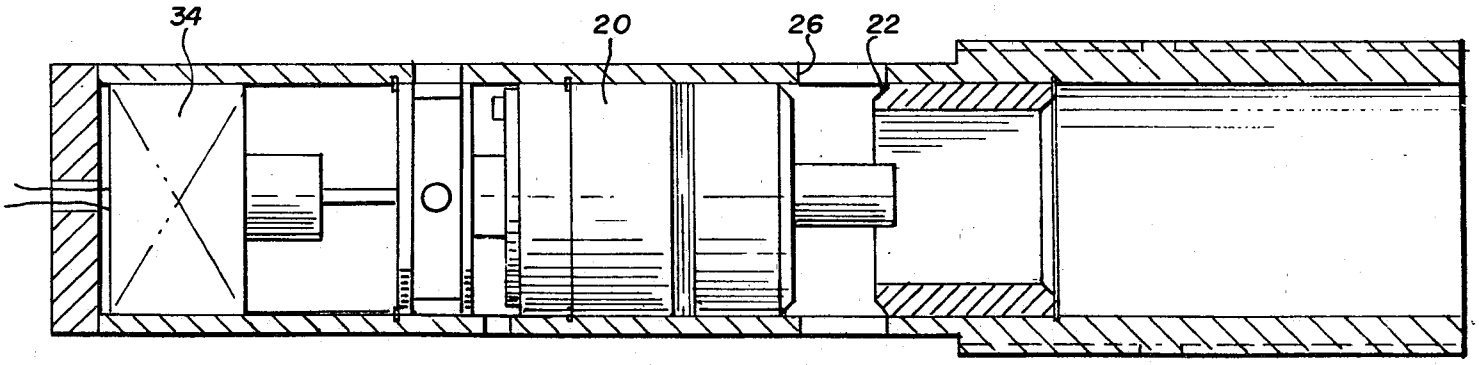
FIG. 4 represents the side view of FIG. 3 but with the sliding piston moved to the rear for the quick dump or blast.

As seen in FIG. 1, a chamber or tank 10 has a forward outlet 12 of rather large size which is threaded to receive a pipe blast nozzle 14. The outer threaded portion 14A of the blaster nozzle is also adapted for mounting the blaster in a threaded wall portion 15 of a conventional bin or tank. The interior of this nozzle has mounted therein a reduced diameter front tubular sleeve or stop 16 which is sized to produce a press fit within a regular diameter bore portion 18 within which is slidably carried a pipe piston 20 having a chamfered end 21. As shown, on the inner or leftward face of the front sleeve 16 is a chamfer 22 for a purpose to be hereinafter more fully described. Piston 20 is slidable in the bore 18 of a pipe 14 which has a reduced outer diameter 24. A plurality of large outlet holes 26 are sized and positioned so that these holes 26 are in a plane substantially normal to the axis of the pipe. When the piston 20 is moved back from in way of these holes, the air in the tank 10 may be readily dumped for a fast discharge through the blast nozzle 12. Intermediate and towards pipe 14 and the reduced outer diameter 24 is a header 28 which has a bored passageway therethrough. A rigid tube 30 is a press fit in this passageway and in the regular bore of this tube is a small diameter piston 32 which is moved in this tube to two limits of position. As shown, a solenoid 34 is connected by a rod 36 to this piston and in response to an electric signal this solenoid is moved from a forward limit, seen in FIGS. 2 and 5, to a rear limit as seen in FIG. 3. A small tubular seal 38 is fastened in the bore of this tube 30 and the face of this seal or the piston itself is made sufficiently resilient so that when the piston 32 is moved forwardly or rightwardly (FIG. 2) to engage the seal 38 it closes the interior of this tube 30 to the flow of pressurized air forwardly of the piston.

BLASTER AS SEEN IN FIGS. 2 THROUGH 5

The header member has a plurality of radially arranged holes 40 which communicate with like holes 42 in tube 30 to carry pressurized air from the outside of the tank to the tube 30. As shown in FIG. 1, an inlet 44 in the side of the tank 10 is adapted to receive a commercial fitting 46 which is connected to a flexible tube 48 which provides an air conduit from the outside of the tank to the quick release apparatus. This flexible tube 48 (FIG. 1) at its inner end is connected by a fitting 50 through the reduced diameter 24 and to the header member 28 in such a manner that pressurized air is fed from an outside source and to holes 40 in the header member. In FIGS. 2 and 5*a* distributing groove 52 formed in the periphery of header member 28 is shown and is contemplated as carrying pressurized air from the tube 48 to the several holes or passageways 40 and then to the tubular member 30.

Figure 5:
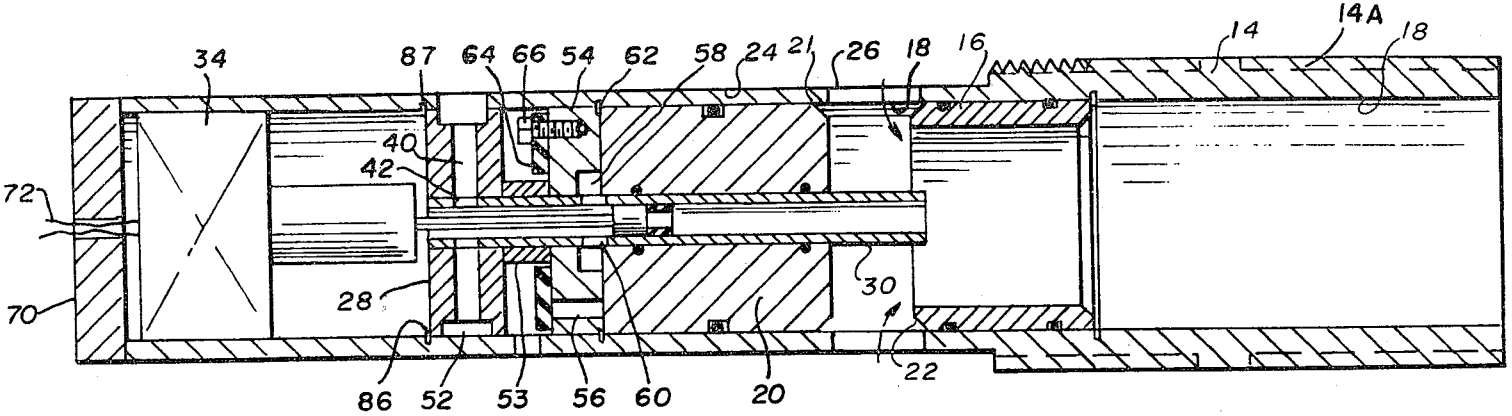
FIG. 5 represents the side view of FIG. 2 and with the piston now moved forwardly to the position shown in FIG. 2 but with the sliding piston still to the rear of the quick blast holes in the discharge pipe, said sliding piston being moved by pressurized air to the closed condition of FIG. 2 after a short period by the inflow of pressurized air behind the sliding piston.

A small tubular spacer 53 (FIG. 5) is carried on the tube 30 and provides a determined spacing between the header member 28 and a spacer disc 54, which disc may be of plastic or metal and is a sliding fit in the regular diameter bore 18. This spacer disc is also a sliding fit on the rigid tube 30 and has a plurality of through holes or passgeways 56 formed in its mid area. These holes 56 are adapted for the passage of pressurized air from the right to the left side of this disc. In the right face as viewed and next to its seating on the rigid tube, there is formed in the disc 54 an undercut 58 (FIG. 5). A plurality of holes 60 are formed in the rigid tube 30 and are disposed to open and flow the pressurized air from the interior of said tube 30 to the undercut 58. This undercut is in the face of the spacer disc 54 and the forward outer portion of this disc is engaged and retained by a snap ring retainer 62 which is mounted in a groove formed in the regular diameter bore 18.

The rear face of the spacer disc 54 carries a flexible disc 64 which is shown as fastened in place by cap screws 66 mounted in appropriately formed threaded holes in disc 54. This flexible disc 64 bends leftwardly, as shown in FIG. 2, when the small piston 32 is at its rightward limit and holes 56 are uncovered and pressurized air flows forwardly in the tube 30. This pressurized air after passing through holes 56 in disc 54 and past deflected flexible disc 64 flows through holes 68 formed in the pipe 14 and then into the tank 10 to pressurize the tank. As and when the small piston 32 is moved to its rearward or left limit as in FIG. 3, the flexible disc 64 closes the holes 56 as pressurized air enters through holes 68 to apply a force on the left face of flexible disc 64 and close holes 56 to a reverse flow of pressurized air.

The solenoid 34 (FIGS. 2 and 5) is depicted as carried in the pipe 14 which is closed at its rear end by a disc 70. A pair of electrical conductors 72 usually are in a flexible sheath and extend from the solenoid to and through disc 70 to a pressure-tight connector 74 in a wall portion of the tank 10 as seen in FIG. 1.

USE AND OPERATION

It is to be noted that the container 10 is usually of steel construction and is rated and tested for a determined p.s.i. of pressurized air. These containers may also be made of plastic and of any desired configuration in either metal or plastic. The large inlet to the container permits the quick dump apparatus to be assembled and tested before mounting in the container and at any later time this apparatus can be removed from the bin or tank 15 for ready replacement or repair. This large inlet also permits the outlet pipe or blast nozzle 14 and the quick dump piston 20 to be of a sufficient size to enable a large volume jet blast to flow from the container into the bin.

The pipe thread shown is suggested as a preferred means of securing the pipe 14 and quick dump apparatus in a threaded outlet 12 in the container or tank 10. A flange or a locking taper might also be employed. Whatever the method of mounting it is desirable that the pipe and quick dump apparatus be readily removable and insertable. The pressurized air conduit 48 is preferably a flexible hose or tube and is secured from the outside and usually by a nut to an outlet 46 in the tank or container. The tube and the connection through the wall of the container are made pressure tight. In a like manner the electrical conductors 72 are flexible wires leading to a connector 74 in the container or tank. The connector 74 is a pressure-tight fitting which can be secured from the outside. There are many commercial fittings which may be employed.

The front tubular stop or sleeve 16 is shown as having one or more O-ring outer seals 75 and an outer snap-type retainer ring 76 by which the forward or outward movement of this stop is limited and established. This snap or retainer ring 76 enables this tubular sleeve to be removed for repair or replacement of other components of the quick release apparatus. The front inner edge of this tubular stop is chamfered 77 to reduce the level of noise as pressurized air flows outwardly past the end of the tubular stop 16. The outer end of the pipe 14 may have flats or grooves formed therein to assist in removing or screwing out the pipe and contained dump apparatus.

The pipe piston 20 is preferably made of plastic because of weight and inertia. As shown, an O-ring seal 78 is carried by the piston 20 in an outer peripheral groove 79. This O-ring may be omitted where and when the piston is a reasonably close fit. Small O-rings 80 are carried in grooves in the piston surrounding tube 30 to seal this piston to air flow along the tube. That portion of the face of the pipe piston 20 that engages the rear portion of the front tubular sleeve 16 may have a rubber or similar resilient sealing means.

The spacer disc 54, as shown, has an undercut 58 formed in its front face and establishes a pathway for pressurized air from the small tube 30 through the plurality of holes 42. The outer front face of spacer disc 54 is retained by a snap ring 62 which establishes a back stop limit of the pipe piston 20. This disc undercut 58 also enables a force source to be produced which utilizes pressurized air flowing through holes 42 to urge the pipe piston 20 forwardly to seal the holes 26. The snap ring 62 carried in a groove formed in the pipe establishes the forward position of the spacer disc 54 while a small tubular spacer 53 carried by and on the tube 30 and between the spacer disc 54 and header member 28 keeps these two members at a determined spacing.

The flexible disc or seal 64 is normally made of sheet material die cut to the desired configuration and with apertures therein for the passing through of cap and retaining screws 66. This flexible disc may be of rubber or plastic and is preferably about thirty Durometer. Rather than screws 66, adhesive may be used to secure the flexible disc to the spacer disc so that the flexible disc is brought into close proximity of the holes 56 formed in the spacer disc. Rather than one disc, a plurality of flexible portions can be provided as long as each hole 56 is covered and flow of pressurized air therethrough is stopped when the small piston is moved in the tube to cut off flow to the outlet holes 60 in the tube.

The rigid tube 30 may be of metal or plastic. The outer surface along which the pipe piston moves is a reasonably constant diameter so that loss of pressurized air along the tube and by the pipe piston 20 is kept to a minimum. The bore of this tube is also of a constant diameter along the tube portion in which the piston 32 is moved by the solenoid 34. The small tubular seal 38 may be of metal or plastic and is secured in place by pins, adhesive or other means. At its forward limit the piston 32 engages this seal 38 to shut off the flow of air to and through the bore of the small tube. This small piston 32 may be of metal with a resilient face portion of plastic or of rubber or a combination of these materials.

The header member 28 may be of plastic or metal. Once installed this member is relatively immobile in the pipe. A snap ring and groove 86 and 87 is provided in the pipe bore 18 at the rear of this member. In cooperation with the spacer disc 54 and spacer member 53 snap ring 62 is mounted in a groove at the front of this spacer disc and therewith establishes and positions these components in the pipe 14.

The conduit inlet 50 through the wall of the pipe 14 contemplates a removable connection of commercial construction. The outlet of this connection feeds pressurized air to the header member 28. As shown, in addition to the radially arranged holes 40 there may be an outer distributing groove 52 adapted to carry pressurized air from the fitting 50 to the several drilled holes 40 leading to the holes 42 in the tube 14. Although not shown, a distributing groove may be formed in this header member at its inner diameter. Such an inner groove eliminates the necessity of alignment of the radially disposed holes in the header member with the small inlet holes 42 in the tube 30.

OPERATION OF QUICK DUMP APPARATUS OF FIGS. 2 THROUGH 5

In FIG. 2, the pressure tank has just emptied and the solenoid has moved the piston 32 forwardly to the tubular seal 38. Holes 60 in the tube 30 are now uncovered and pressurized air flows through the conduit 48 through the holes 40 to the header 28 and into and through the tube 30 to holes 60 formed therein. This pressurized air fills first the small undercut 58 in the face of the spacer disc 54 and then a developing chamber behind pipe piston 22, which is thus moved forwardly toward and to tubular sleeve 16 to close outlet holes 26. After the piston has moved to its forward limit and the area chamber to the left of this piston 20 has approached or is equal to the pressure in the conduit 48, the pressurized air flows into the tank.

In FIG. 2, the pipe piston 20 is shown as moved to the right to seal off discharge from the tank through holes 26. Pressurized air to the rear of piston 20 now flows through holes 56 in the spacer disc 54 and bends the flexible disc 64 allowing pressurized air to flow into that space between the header member and the spacer disc. This pressurized air flows from this space through holes 68 and into the now closed tank to bring this tank to the desired pressure of air.

After a determined interval of time during which the tank becomes pressurized, the solenoid 34 is actuated to draw the small piston 32 to the position seen in FIG. 3. This small piston 32 moves to the left or rearwardly of the holes 60 and shuts off the flow of pressurized air from the conduit 48 to and through the tube 30. Air from the area immediately to the left of and rear of pipe piston 20 flows to the holes 60 and thence rightwardly through the tube 30 and through the discharge outlet. The pressurized air in the tank 10 flows through holes 68 into the space immediately to the left or rearward of the flexible disc or seal 64 to cause this disc or seal to close through holes 56. The reduced pressure to the rear of pipe piston 20 and the pressure in the tank acting on the chamfered portion at the front outer edge adjacent this piston causes a rearward fast movement of this piston to the position as seen in FIG. 5. This uncovers holes 26 in pipe 14 permitting a quick dump or blast of the pressurized air in the tank or container 10 to flow out of the large open end of pipe 14 into the bin, not shown. That air in the area between the header 28 and the spacer disc 54 flows from this space into the tank and becomes equalized with the pressure in the tank 10.

In FIG. 5 is seen the apparatus immediately following the quick dump condition with the piston 20 adjacent to the spacer disc 54. Holes 26 are uncovered and the small piston 32 blocks flow of pressurized air from the header 28 to the discharge from the pipe nozzle 14. In FIG. 5 the pressure in the tank 10 is rapidly reduced to a low pressure as it is discharged through the uncovered holes 26 and through the large open end of the pipe 14. Pressurized air continues to flow into the undercut 58 through holes 60 and moves large piston 20 forwardly until stopped by sleeve 16. The pressurized air to the right thereof causes movement of pipe piston 20 forwardly to close holes 26. The pressurized air flows through passageways 56 to deflect flexible disc 64 and to flow past the disc and through the holes 68 to fill container 10 as seen in FIG. 2.

AS A METHOD

As a method the apparatus of FIGS. 1 through 5 provides for the receiving and storing of a charge of pressurized air in a container of a determined and selected size; providing and positioning a blast nozzle at one end of this container; quick releasing the accumulated pressurized air from the container through this nozzle by means of a quick dump valve apparatus positioned within this container, said quick dump valve including a removable pipe within which is removably mounted a slidable large piston which is freely movable to two limits, at the forward limit the piston closes the valve to a flow of pressurized air from the container, and at the rear limit the piston uncovers outlet holes formed in the removable pipe to quick release the pressurized air from the container; actuation of the movement of this large piston is by reciprocation of a small piston by a solenoid, this small piston is movable in the small tube extending through the large piston which is slidable on this tube.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position in which the quick dump valve and air blast apparatus may be constructed or used.

While a particular embodiment of the air blaster has been shown and described it is to be understood the invention is not limited thereto since modifications may be made within the scope of the accompanying claims and protection is sought to the broadest extent the prior art allows.

What is claimed is:

1. An air accumulator and quick release apparatus for producing a blast of pressurized air into a storage bin for material, said apparatus including:

(a) a pressure tank and means for removably mounting said tank exterior of said bin, the pressure tank adapted to receive and store pressurized air, said tank having a large opening formed therein;

(b) a removable pipe mounted in said large opening and with said pipe having an open and a closed end and when mounted in said large opening the open end of the pipe is within the bin and adapted to direct the blast into the interior of the bin;

(c) a quick air release apparatus carried within said pipe and within said pressure tank when the pipe is mounted within the large opening of the pressure tank;

(d) a smoothly formed bore of regular diameter provided in the removable pipe;

(e) a front tubular stop carried within the bore in said pipe, said stop secured so that with the pipe mounted within the tank the extending open end of the pipe discharges the pressurized air within the bin and a rear end of the front tubular stop is within the tank;

(f) a multiplicity of discharge holes formed in the pipe, said holes arranged in a plane substantially transverse to the axis of the smoothly formed bore in the pipe and with the forward edges of these holes disposed toward the open end of the pipe and with said forward edges of the holes adjacent and inwardly of the rear end of the front tubular stop;

(g) a pipe piston slidable in said bore and sized so as to provide a minimum of air loss for and during movement of said piston in said smooth bore, a forward movement of the pipe piston established by the front stop, this forward movement of the piston as it engages this stop covering the discharge holes sufficiently to shut off the flow of pressurized air from the tank;

(h) means provided in the smooth bore of the pipe and limiting the rearward movement of the pipe piston and at this rearward limit of movement the discharge holes in the pipe are uncovered for a free flow of air from the tank to the interior of the pipe forwardly of the piston and from this pipe through the open end of the pipe and into the bin;

(i) a header member carried and mounted in the smooth bore of the pipe and rearwardly of the pipe piston, said header adapted to receive and deliver pressurized air to the interior portion of the pipe;

(j) a small rigid tube carried by the small header member, said small tube extending through an aperture central of the pipe piston, said tube disposed to carry pressurized air from the header member;

(k) an air conduit adapted to carry pressurized air from an external source outside of said pressure tank to and through said tank and to the header member thence to the interior of the small rigid tube;

(l) a piston carried in the bore of the small tube and reciprocably movable therein to forward and rear limits of movement;

(m) means for moving this small piston in the bore of this small tube to said two limits of movement;

(n) a small tubular seal having an opening therethrough, said tubular seal secured in the bore of the small tube, this tubular seal positioned in the tube so as to engage the face of the small piston at a forward limit of movement to effect a shut off of flow of pressurized air through the small tube and forwardly of the small piston;

(o) a plurality of outlet holes formed in the sidewall of the small tube, said plurality of outlet holes positioned so that at the forward limit of movement of the small piston the outlet holes in the small tube are uncovered allowing pressurized air to flow from the header member through the tube and then from the outlet holes into that portion of the pipe to the rear of the pipe piston, the pressurized air flowing into said pipe portion urging the pipe piston forwardly toward and to the front tubular stop in the pipe;

(p) a one-way valve provided in the pipe and adapted to permit flow of pressurized air from the interior portion of the pipe to the rear of the pipe piston and then through the one-way valve through conducting passageways to the interior of the pressure tank, the small piston in the rigid tube when moved from sealing engagement with the tubular seal in the small tube and to its rear limit of movement is rearwardly of the outlet holes in the small rigid tube and closes the small tube to the influent flow of pressurized air and opens that pipe area rearwardly of the pipe piston to allow the pressurized air in said portion to flow from this area through the plurality of outlet holes in the tube and through the tube to the open end of the pipe and into the bin to reduce a forward force on the piston, and, (q) a complementary chamfer provided between the outer front edge of the pipe piston and the rear of the front tubular stop in the pipe, said chamfer providing a force surface upon which the pressurized air flowing from the tank impinges to urge the pipe piston rearwardly.

2. An air accumulator and quick release apparatus as in claim 1 in which the air conduit is a flexible tube leading from a removable connection in the outer wall of the pressure tank to a removable connection at said header member.

3. An air accumulator and quick release apparatus as in claim 1 in which the means for moving the small piston in the small tube to two limits of movement is an electric solenoid.

4. An air accumulator and quick release apparatus as in claim 3 in which the solenoid is carried in the bore of the pipe and a closure of the inner end of the pipe is made after the solenoid is mounted in the pipe.

5. An air accumulator and quick release apparatus as in claim 4 in which electrical conductors extend from the solenoid to an electrical connector mounted in a wall of the tank.

6. An air accumulator and quick release apparatus as in claim 1 in which the one-way valve includes a spacer disc secured in the bore of the pipe and having a through passage for and through which the small tube extends, said spacer disc sealed at its outer and inner peripheries to provide a barrier to the flow of pressurized air; a plurality of holes formed in the disc and providing a passage of pressurized air from one side of the disc to the other, and a flexible disc adapted to engage that face of the spacer disc away from the movable pipe piston, said flexible disc adapted to cover and close the holes in the spacer disc when pressurized air applies a closing force on the flexible disc.

7. An air accumulator and quick release apparatus as in claim 6 in which the flexible disc is of rubber-like material and is secured to the face of the spacer disc away from the pipe piston and the pressurized air entering the pressure tank through the air conduit flows through the small tube to and through the outlet holes in the small tube thence to and through the holes in the spacer disc causing movement away from said holes by the flexible disc and the pressurized air then flows to and through outlet holes in the pipe disposed to the rear of the spacer disc.

8. An air accumulator and quick release apparatus as in claim 7 in which the plurality of outlet holes in the small rigid tube is adjacent a forward face of the spacer disc.

9. An air accumulator and quick release apparatus as in claim 8 in which the spacer disc and header member are retained in the desired attitude in the pipe by retaining rings secured in previously formed grooves formed in the internal bore of the pipe.

10. An air accumulator and quick release apparatus as in claim 1 in which the removable mounting for the apparatus in the bin is a threaded aperture formed in the bin wall and a complementary threaded portion is formed on and at the open end of the pipe.

11. An air accumulator and quick release apparatus as in claim 1 in which seal means are provided on the pipe piston to seal the outer periphery of said piston as it moves in the smooth bore of the pipe, and an added seal means is carried in grooves formed in the pipe piston as it is moved, said added sealing means sealing around the small rigid tube.

12. An air accumulator and quick release apparatus as in claim 1 in which the chamfer providing the rearward urge to the movement of the pipe piston is a chamfer formed on the outer rear edge of the front tubular stop in the pipe.

13. An air accumulator and quick release apparatus as in claim 2 in which the header member has a plurality of air passageways formed therein and with said passageways adapted to carry and conduct pressurized air from the conduit to a plurality of inlet holes in the small rigid tube by and through which pressurized air enters the small rigid tube at a position which is rearwardly of the small tube piston.

14. An air accumulator and quick release apparatus as in claim 1 in which the chamfer providing the rearward urge to the pipe piston is a chamfer formed on the outer front edge portion of this pipe piston.

15. An air accumulator and quick release apparatus as in claim 1 in which the chamfer providing the rearward urge to the pipe piston is a chamfer formed on both the outer rear edge of the tubular stop in the pipe and also a chamfer formed on the outer front edge portion of this piston.

16. A method for the receiving and storing of a charge of pressurized air in a tank of a determined and selected size, and quick releasing said charge in said tank as a blast of air into a storage bin, said method steps including:

(a) providing and positioning a pressure tank outside of the bin with a removable and communicating pipe extending into the bin and into the pressure tank, said pipe having an open end within the bin and a closed end within the tank;

(b) positioning the pipe in the wall of the tank and the wall of the bin and forming this pipe with a smooth bore;

(c) positioning and securing a front tubular stop within said bore so that the rear face of this stop is within the pressure tank when the tank is mounted for use with said bin and providing the forward limit of movement for a pipe piston freely slidable in said pipe bore;

(d) providing a rear stop means in the smooth bore of the pipe and thereby limiting the rearward movement of the pipe piston;

(e) forming a multiplicity of discharge holes in said pipe, said holes arranged in a plane substantially transverse to the axis of the smoothly formed bore in the pipe and with the forward edges of these holes disposed toward the open end of the pipe and with said forward edges of the holes adjacent and inwardly of the rear end of the front tubular stop;

(f) positioning a header member and a small rigid tube carried thereby within the smooth bore of the pipe, the header member disposed to the rear of the pipe piston and the small tube extending through the pipe piston with sealing means to prevent air leakage as the pipe piston is cycled along this small rigid tube;

(g) positioning and moving a small piston in the bore of the small rigid tube and providing means for reciprocably moving this piston to two limits of movement;

(h) securing a small tubular seal in the bore of the small tube, said seal having an opening therethrough, the tubular seal positioned in the tube so as to engage the face of the small piston at a forward limit of movement to effect a shut off of flow of pressurized air through the small tube and forwardly of the small piston;

(i) forming a plurality of outlet holes in the sidewall of the small tube, said plurality of outlet holes positioned so that at the forward limit of movement of the small piston the outlet holes in the small tube are uncovered allowing pressurized air to flow from the header member through the tube and then from the outlet holes into that portion of the pipe to the rear of the pipe piston, the pressurized air flowing into said pipe portion urging the pipe piston forwardly toward and to the front tubular stop in the pipe;

(j) providing and positioning a one-way valve within the pipe so as to permit flow of pressurized air from the interior pipe portion to the rear of the pipe piston then through the one-way valve through conducting passageways to the interior of the pressure tank, the small piston in the rigid tube when moved from sealing engagement with the tubular seal in the small tube and to its rear limit of movement is rearwardly of the outlet holes in the small rigid tube and closes the small tube to the influent flow of pressurized air and opens that pipe area rearwardly of the pipe piston to allow the pressurized air in said portion to flow from this area through the plurality of outlet holes in the tube and through the tube to the open end of the pipe and into the bin to reduce a forward force on the piston;

(k) providing and positioning an air conduit so as to carry pressurized air from an external source outside of said pressure tank to and through said tank and to the header member thence to the interior of the small rigid tube, and (l) providing a complementary chamfer between the outer front edge of the pipe piston and the rear of the front tubular stop in the pipe, said chamfer providing a force surface upon which the pressurized air flowing from the tank impinges to urge the pipe piston rearwardly.

* * * * *